310-14 SR
8/6/85 XR 4,533,890

United States Patent [19]

Patel

[11] Patent Number: 4,533,890

[45] Date of Patent: Aug. 6, 1985

[54] PERMANENT MAGNET BISTABLE SOLENOID ACTUATOR

[75] Inventor: Balkrishna R. Patel, Troy, Mich.

[73] Assignee: General Motors Corporation, Detroit, Mich.

[21] Appl. No.: 685,547

[22] Filed: Dec. 24, 1984

[51] Int. Cl.[3] ..... H01F 7/00

[52] U.S. Cl. ..... 335/234; 310/14; 310/30; 335/229

[58] Field of Search ..... 310/12, 14, 15, 30, 310/34, 35, 229, 230; 335/235, 267, 234, 261

[56] References Cited

U.S. PATENT DOCUMENTS

| | | | |
|---|---|---|---|
| 3,040,217 | 6/1962 | Conrad | 335/256 X |
| 3,202,886 | 8/1965 | Kramer | 335/234 |
| 3,420,492 | 1/1969 | Ray | 251/68 |
| 3,460,081 | 8/1969 | Tillman | 335/234 |
| 3,514,674 | 5/1970 | Ito et al. | 335/234 X |
| 3,634,735 | 1/1972 | Komatsu et al. | 335/234 X |
| 3,728,654 | 4/1973 | Tada | 335/234 |
| 3,743,898 | 7/1973 | Sturman | 335/234 X |
| 3,889,219 | 6/1975 | Larner | 335/234 |
| 4,097,833 | 6/1978 | Myers | 335/261 |
| 4,122,423 | 10/1978 | de Bennetot | 335/234 |
| 4,240,056 | 12/1980 | Mayer | 338/267 |
| 4,253,493 | 3/1981 | English | 335/234 X |

FOREIGN PATENT DOCUMENTS 1089596 11/1967 United Kingdom .

*Primary Examiner*—Donovan F. Duggan
*Attorney, Agent, or Firm*—Mark A. Navarre

[57] ABSTRACT

A bistable actuator comprising a permanent magnet assembly secured to an armature shaft and a pair of core elements axially disposed on either side of the permanent magnet assembly. The cores have axially opposed inner and outer annular extensions defined in each core by a central axial opening which supports the armature shaft and an annular recess in which is received an electrical coil. The permanent magnet assembly comprises inner and outer annular axially magnetized permanent magnets radially spaced by a ferromagnetic ring so as to be aligned with the inner and outer core extensions.

2 Claims, 7 Drawing Figures

PERMANENT MAGNET BISTABLE SOLENOID ACTUATOR

This invention relates to a solenoid actuator and more particularly to an actuator having permanent magnets for maintaining the armature thereof in either of two positions.

Actuators of the above type are generally referred to as bistable actuators since the armature is stable in either of its positions without the consumption of externally supplied electrical power. Power is only consumed in moving the armature from one position to the other. Although such actuators would seem ideal in applications where low power consumption is particularly important, they usually suffer from slow response and limited armature travel.

To improve the armature travel aspect, it has been proposed, as for example in the U.S. Pat. No. 3,202,886, to Kramer, issued Aug. 24, 1965, to configure the armature and core such that armature movement is effected in response to a combination of repulsive and attractive magnetic forces. The repulsive force is dominant during initial armature movement and the attractive force becomes dominant as the armature approaches its final or target position. However, such an effect has not been achieved in the prior art without worsening the actuator speed of response.

The object of the present invention is to provide an improved bistable actuator having an armature and core geometry that results in relatively fast speed of response as well as relatively large armature travel.

The core of the actuator is comprised of two axially spaced ferromagnetic elements having inner and outer annular extensions defined in each element by a central axial opening for receiving the armature shaft and an axial annular recess in which an electrical coil is mounted. The armature assembly comprises inner and outer axially magnetized rare-earth ring magnets of opposite polarity which are radially spaced by a ferromagnetic ring and attached to the armature shaft for axial movement therewith. The width of the ring magnets corresponds to the width of the core element annular extensions, and the ferromagnetic ring spaces the ring magnets so that they are axially aligned with the respective annular core element extensions. When the armature assembly is in a first position, the ring magnets are in close proximity to one of the core elements and magnetic flux lines are established through each of the magnets and the intermediate ferromagnetic ring which develop a retaining force for maintaining the armature assembly in such position. When the armature assembly is in the other of its positions, the ring magnets are in close proximity to the other core element, and magnetic flux lines are established through the magnets and the intermediate ferromagnetic ring which develop a retaining force that maintains the armature assembly in such position. When the electrical coils of each core element are energized with electrical current, the armature shifts position in response to the repulsive magnetic force between the permanent magnets and the core element in close proximity thereto and the attractive magnetic force between the permanent magnets and the opposing core element.

The novel armature and core configuration of this invention yields improved speed of response in two ways. First, the core design, while capable of generating attractive and repulsive forces to move the armature is amenable to lamination, if desired. As a result, eddy current losses in the core are reduced and speed of response is increased. Second, the armature assembly is configured to take advantage of the small size and high flux density properties of the rare-earth magnets. As a result, the armature assembly is lightweight and contributes to improved speed of response.

In a preferred embodiment, the magnets are secured to the ferromagnetic ring with a suitable adhesive to form an assembly which is then potted with epoxy or a similar substance, and encapsulated in a container of stainless steel or other nonmagnetic material. The container, in turn, is then welded or otherwise secured to the armature shaft for movement therewith.

IN THE DRAWINGS

Figure 1:
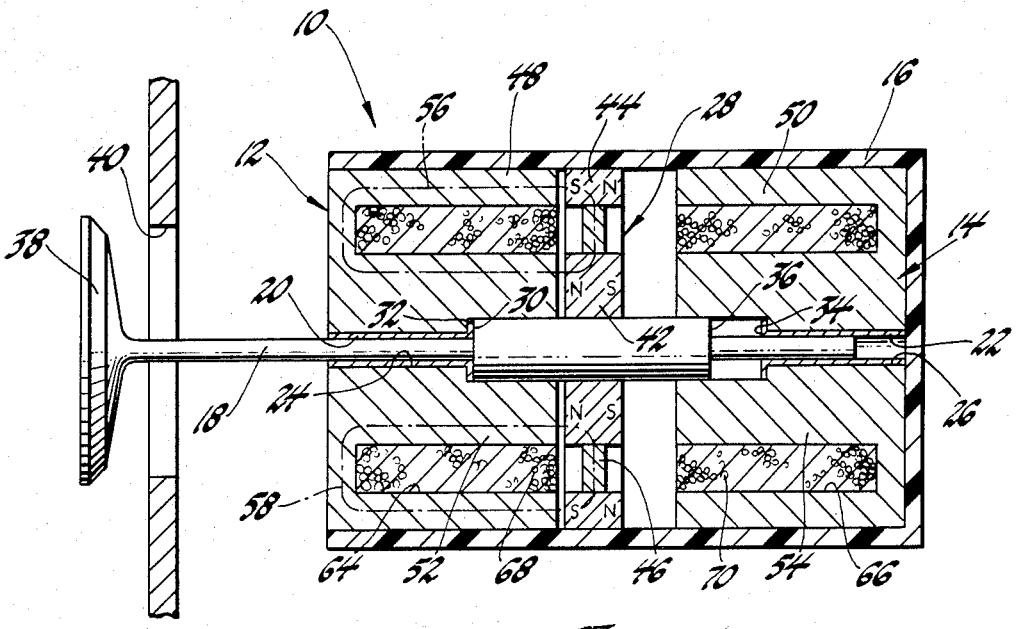
FIGS. 1 and 2 are schematic drawings depicting the actuator of this invention in each of its two stable positions with the solenoid coil de-energized.
Figure 2:
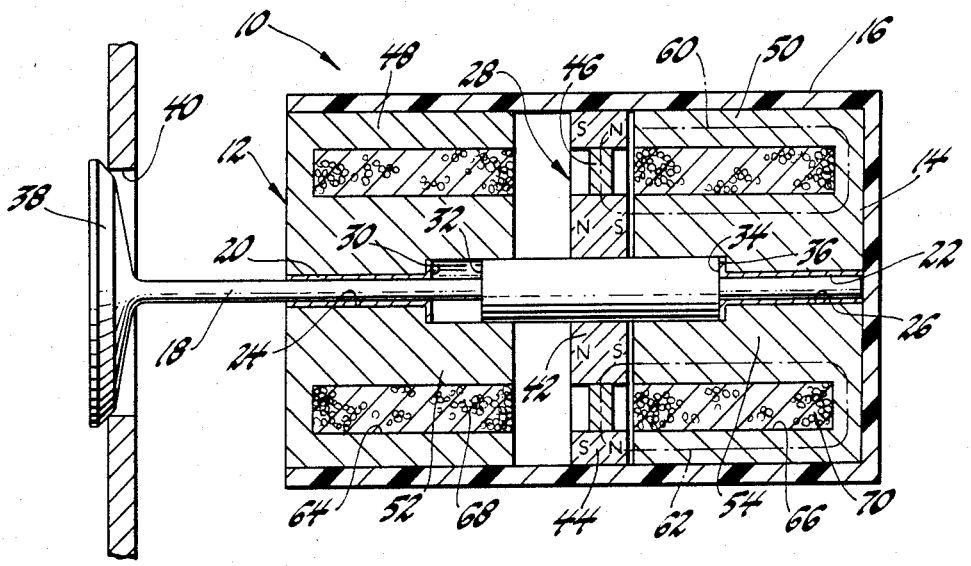

Referring now more particularly to FIGS. 1 and 2, the reference numeral 10 generally designates the permanent magnet bistable solenoid actuator of this invention. Essentially, the actuator 10 comprises two axially spaced core elements 12 and 14 disposed within a housing member 16, an armature shaft 18 supported for axial movement on a pair of bushings 20 and 22 disposed within central axial openings 24 and 26 in the core elements 12 and 14, and a permanent magnet assembly 28 secured to the armature shaft 18 at a point between the core elements 12 and 14. Leftward movement of the armature shaft 18 as shown in FIGS. 1 and 2 is limited by the stop 30 when engaged by the armature shaft boss 32. Similarly, rightward movement of the armature shaft 18 is limited by the stop 34 when engaged by the armature shaft boss 36. The relative placement of the stops 30 and 34, the bosses 32 and 36, and the permanent magnet assembly 28 is such that the permanent magnet assembly is prevented from coming into contact with either of the core elements 12 and 14. The armature shaft 18 is rigidly secured to or integral with a load device such as the valve 38 which is adapted to open or close the port 40 depending on the axial position of armature shaft 18.

Figure 5:
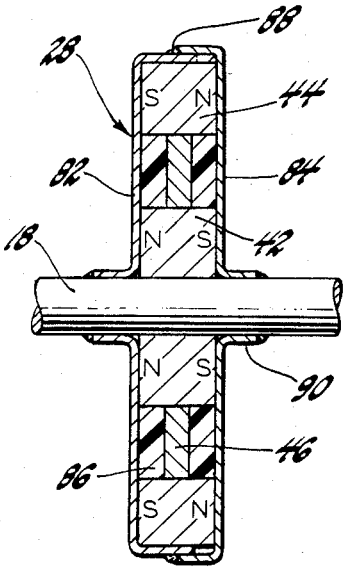
FIG. 5 is a cross-sectional drawing depicting the preferred construction of the armature assembly.

The permanent magnet assembly 28 comprises inner and outer axially magnetized permanent magnets 42 and 44 of opposite polarity and a ferromagnetic ring 46 secured therebetween. The preferred arrangement for securing the permanent magnet assembly to the armature shaft 18 is shown in FIG. 5. The widths of the magnets 42 and 44 and the ring 46 are such that the magnet 44 is in axial alignment with the core element outer annular extensions 48 and 50, and the magnet 42 is in axial alignment with the core element inner annular extensions 52 and 54. As noted above, the magnets 42 and 44 are preferably formed of a high flux density rare-earth material such as samarium-cobalt.

When the armature shaft 18 is in the leftmost (open) position as shown in FIG. 1, the permanent magnet assembly 28 is in close proximity to the core element 12, and a magnetic flux is generated by magnets 42 and 44 in paths through magnets 42 and 44, ferromagnetic ring 46, and the core element inner and outer annular extensions 52 and 48 as shown by the lines 56 and 58. Such flux produces an attractive force between the permanent magnet assembly 28 and the core element 12 which opposes any load force urging the armature shaft 18 in the other or rightward direction. Similarly, when the armature shaft 18 is in the rightmost (closed) position as shown in FIG. 2, the permanent magnet assembly 28 is in close proximity to the core element 14, and a magnetic flux is generated by magnets 42 and 44 in paths through magnets 42 and 44, ferromagnetic ring 46, and the core element inner and outer annular extensions 54 and 50 as shown by the lines 60 and 62. Such flux produces an attractive force between the permanent magnet assembly 28 and the core element 14 which opposes any load force urging the armature shaft 18 in the other or leftward direction.

As noted above, the configuration of the core elements 12 and 14 allows them to be laminated, thereby reducing eddy current losses and increasing the speed of response. The core elements 12 and 14 have complementary annular recesses 64 and 66 formed therein for receiving the electrical coils 68 and 70, respectively. The coils 68 and 70 are effective when concurrently energized with direct current of suitable polarity to develop magnetic forces for moving the armature shaft 18 from either of its positions to the other position. For example, to move the armature shaft 18 from its leftmost (open) position depicted in FIG. 1 to its rightmost (closed) position depicted in FIG. 2, the coils 68 and 70 are energized with current of a polarity that causes the inner annular extensions 52 and 54 to assume a North (N) magnetic polarity and the outer annular extensions 48 and 50 to assume a South (S) magnetic polarity. This produces both a repulsive magnetic force between the permanent magnet assembly 28 and the core element 12 and an attractive magnetic force between the permanent magnet assembly 28 and the core element 14. When the permanent magnet assembly 28 is in its leftmost position, the air gap between the magnets 42 and 44 and the core element 12 is at a minimum, and the air gap between the magnets 42 and 44 and the core element 14 is at a maximum. As a result, the repulsive force is at a maximum, and the attractive force is at a minimum. As the armature shaft 18 moves rightward, the repulsive force decreases and the attractive force increases. When the permanent magnet assembly 28 is in its rightmost position, the air gap between magnets 42 and 44 and the core element 12 is at a maximum, and the air gap between magnets 42 and 44 and core element 14 is at a minimum. As a result, the repulsive force is at a minimum and the attractive force is at a maximum. When the armature shaft 18 reaches its new position, the coils 68 and 70 may be de-energized, and the permanent magnets 42 and 44 will hold the position as described above in reference to FIG. 2.

Figure 3:
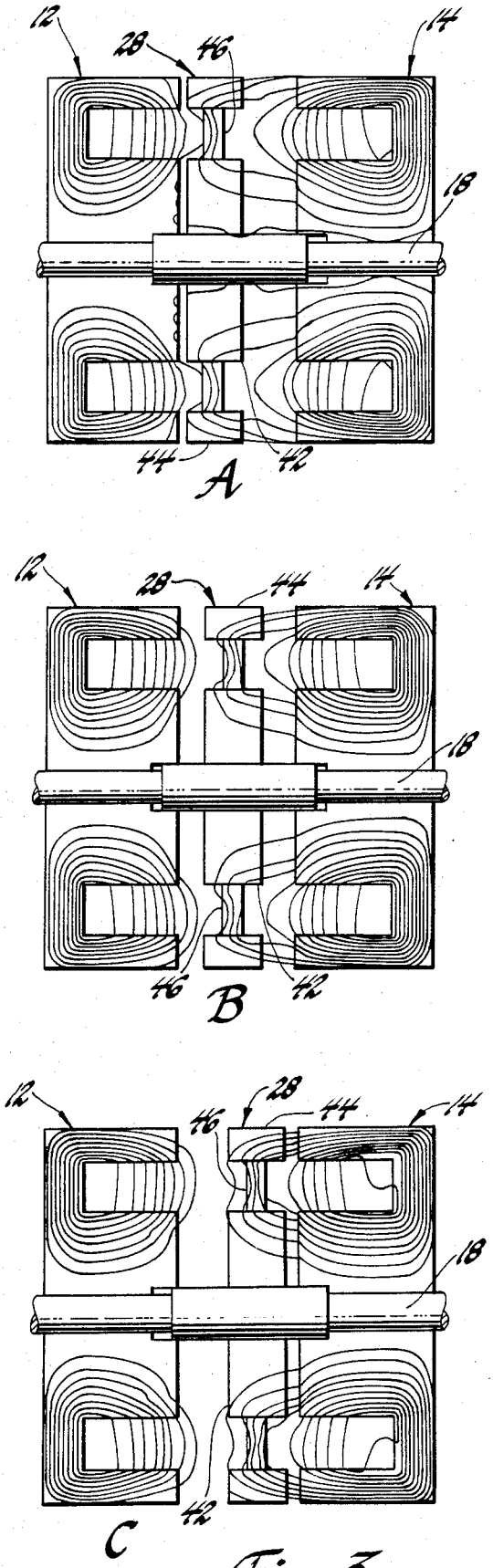
FIGS. 3A–3C are flux plots depicting the magnetic flux distribution in the actuator of this invention when the coils thereof are energized to shift the armature from one position to the other.

Graphic representations of the repulsive and attractive forces described above are given in FIGS. 3 and 4. FIGS. 3A–3C show the magnetic flux distributions in the permanent magnet assembly 28 and the core elements 12 and 14 for three different positions of the armature shaft 18. FIG. 3A depicts the leftmost position as in FIG. 1, FIG. 3B depicts an intermediate position, and FIG. 3C depicts the rightmost position as in FIG. 2.

Figure 4:
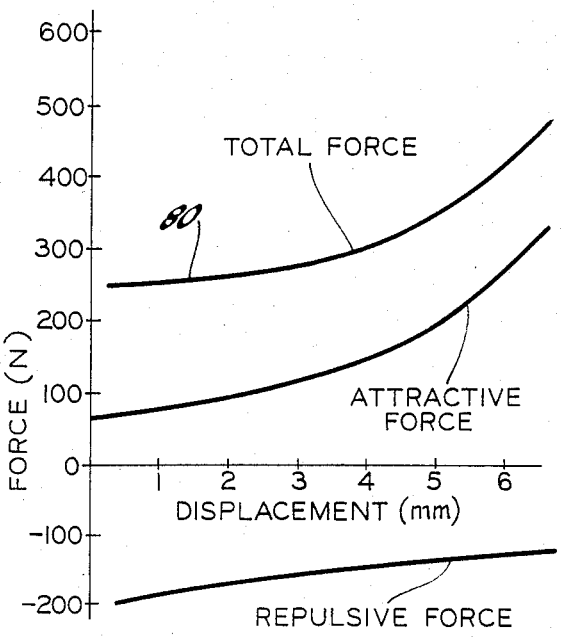
FIG. 4 is a graph depicting the force obtained when the solenoid coils of the actuator are energized to move the armature from one position to the other.

In FIG. 4, the repulsive and attractive forces are given in Newtons (N) for a particular actuator as a function of displacement in millimeters (mm) of the armature shaft 18 from a limit position. The repulsive and attractive forces are additive and combine to provide a total as depicted by the trace 80.

It will be understood, of course, that the magnetic force characteristics described above are developed in equal magnitude and opposite sense when the coils 68 and 70 are energized to move the armature shaft 18 from its leftmost position shown in FIG. 2 to its rightmost position shown in FIG. 1. In both cases, the total force acting on the load device 38 is given by the trace 80 as a function of armature displacement.

The preferred construction of the permanent magnet assembly 28 is shown in FIG. 5. Essentially, the two magnets 42 and 44 are cemented to the inner and outer peripheries respectively, of the ferromagnetic ring 46. That assembly, in turn, is encapsulated within a flanged two-piece container 82, 84 of stainless steel or other nonmagnetic material, and potted in epoxy or similar material. The container pieces 82 and 84 are welded together at the overlapping portion thereof, as indicated by the reference numeral 88, and the container flange 90 in turn is welded to the nonmagnetic armature shaft 18. This construction results in a practical and rugged assembly, able to withstand repeated cycling operation.

As noted above, the actuator of this invention provides improved speed of response as compared to prior bistable actuators capable of relatively large armature travel. The large armature travel characteristic is effected by the concurrent generation of attractive and repulsive magnetic forces, and the fast speed of response characteristic is effected by an armature and core configuration that results in a lightweight armature assembly and a low loss magnetic core.

Although this invention has been described in reference to the illustrated embodiment, it will be understood that various modifications will occur to those skilled in the art and that actuators incorporating such modifications may fall within the scope of this invention, which is defined by the appended claims.

The embodiments of the invention in which an exclusive property or privilege is claimed are defined as follows:

1. A bistable electromagnetic actuator comprising in combination:

first and second ferromagnetic core elements disposed in spaced relation within a housing member, the first and second core elements having axially opposed inner and outer extensions defined in each core element by a central axial opening and an axial annular recess in which is received an electrical coil;

an armature assembly including a nonmagnetic actuator shaft disposed within the central opening of each core and supported thereby for axial movement therein, and inner and outer axially magnetized annular permanent magnets of opposite polarity radially spaced by a ferromagnetic ring so as to be axially aligned with the inner and outer extensions of the first and second core elements, the magnets and ring being secured to the actuator shaft for axial movement therewith so that the magnets are effective when in close proximity to the first core element to hold the actuator shaft in a first axial position and when in close proximity to the second core element to hold the actuator shaft in a second axial position; and so that, the electrical coils are momentarily energizable with electrical current to produce a repulsive magnetic force between the permanent magnets and the core element in close proximity thereto, and an attractive magnetic force between the permanent magnets and the opposing core element.

2. An actuator according to claim 1, wherein the armature assembly is encased within a nonmagnetic container which, in turn, is secured to the nonmagnetic actuator shaft for axial movement therewith.

* * * * *